US009777453B2

(12) United States Patent
Hamilton

(10) Patent No.: US 9,777,453 B2
(45) Date of Patent: Oct. 3, 2017

(54) HYDRAULIC POLE TAMPER HANDLE AND ADAPTER

(71) Applicant: Timothy Hamilton, New Haven (KY)

(72) Inventor: Timothy Hamilton, New Haven (KY)

(73) Assignee: TH Welding & Hydraulics, LLC, New Haven, KY (US)

( * ) Notice: Subject to any disclaimer, the term of this patent is extended or adjusted under 35 U.S.C. 154(b) by 190 days.

(21) Appl. No.: 14/121,646

(22) Filed: Oct. 2, 2014

(65) Prior Publication Data

US 2016/0097176 A1 Apr. 7, 2016

Related U.S. Application Data

(60) Provisional application No. 61/960,977, filed on Oct. 2, 2013.

(51) Int. Cl.

| | |
|---|---|
| ***B25D 17/04*** | (2006.01) |
| ***E02D 3/046*** | (2006.01) |
| ***E02D 13/00*** | (2006.01) |
| ***E01C 19/35*** | (2006.01) |

(52) U.S. Cl.
CPC ..... *E02D 3/046* (2013.01); *E01C 19/35* (2013.01); *E02D 13/00* (2013.01)

(58) Field of Classification Search
CPC ..... B25D 17/043; E02D 3/046; A01B 1/026; A01B 1/22
USPC ..... 74/557; 294/57, 58
See application file for complete search history.

(56) References Cited

U.S. PATENT DOCUMENTS

| | | | | |
|---|---|---|---|---|
| 3,857,448 | A * | 12/1974 | Lines | B25D 9/12 173/127 |
| 4,457,472 | A * | 7/1984 | Geberth, Jr. | B05B 15/064 239/281 |
| 8,161,605 | B2 * | 4/2012 | Reichel | F16L 3/123 24/20 R |
| 8,414,221 | B2 * | 4/2013 | Faucher | E01C 19/35 404/133.05 |
| 2012/0312572 | A1 * | 12/2012 | Nemetz | B25D 17/043 173/162.2 |

* cited by examiner

*Primary Examiner* — Robert Long
*Assistant Examiner* — Eyamindae Jallow
(74) *Attorney, Agent, or Firm* — Carrithers Law Office, PLLC

(57) ABSTRACT

A hydraulic pole tamper with an extended ergonomic handle including a frame and hose clamps to extend the life of the hose by securing the hoses to the frame and to improve the handle, orientation, and usability of the pole tamper. The pole tamper is used to tamp or compact the dirt around a pole which has been set into a hole in the ground to fixedly secure the pole vertically in the ground.

9 Claims, 2 Drawing Sheets

HYDRAULIC POLE TAMPER HANDLE AND ADAPTER

CROSS REFERENCES TO RELATED APPLICATIONS

This application claims priority from U.S. Provisional Application Ser. No. 61/960,977 filed on Oct. 2, 2013 and is incorporated be reference herein in its entirety.

TECHNICAL FIELD

The present invention relates to the field of hydraulic tamping devices used to tamp fill material tightly around a pole set into a post hole in the ground.

BACKGROUND OF THE INVENTION

Wooden utility poles and/or telephone poles are often over forty feet tall and must therefore be set in a deep hole in the ground for stability. Typically, such utility poles are set at least six feet in the ground. Of course, the hole is much larger in diameter than the pole and therefore, dirt must be returned to the hole around the pole little by little and must be tamped or compacted tightly around the pole to provide vertical stability.

To ease the job of tamping the dirt tightly, hydraulic pole tampers are commonly used. The tool is often used by utility crews to back fill a hole after installing a new power pole or by farmers for tamping fill material around new fence posts.

The hydraulic pole tampers come in sizes from 60" to 85" in length. The tamper is a longitudinal tool with two hydraulic hoses connected to the top end, a hydraulic impact unit housed in a long thin body, and a ram head at the bottom. The driving fluid may be air or oil depending upon the application. In some applications an electric motor driven tamper may be used for tamping. However, in the instant application, the driving fluid is hydraulic oil supplied by a reservoir on a vehicle such as a truck which usually includes a hydraulic oil fluid driven derrick or other drilling equipment for setting posts in holes. Without driving fluid and the hoses, the tool weights often weight nearly 30 pounds.

DESCRIPTION OF THE RELATED ART

A typical tamper device is disclosed in U.S. Pat. No. 8,414,221 which is incorporated by reference herein. The tamper device includes a housing, a drive connected the housing, a tamper adapted to reciprocate relative to the housing and apply pressure to a surface, and a wobble connection between the drive and the tamper, wherein the wobble connection comprises a wobble plate, and wherein a first end portion of the tamper is at a side of the wobble plate. The tamper device includes a housing, a drive, a tamper, and a wobble connection. The drive is connected the housing and the tamper is adapted to reciprocate relative to the housing and apply pressure to a surface such as dirt or rock. The wobble connection is between the drive and the tamper, wherein the wobble connection includes a wobble plate with a first end portion of the tamper is at a side of the wobble plate. More particularly, the tamper device includes a housing, a rotatable shaft, a camming member, a connecting rod, and a tamper wherein the rotatable shaft has a first end and a second end. The first end is adapted to be connected to a drive and the second end extends into the housing whereby the camming member is connected to the rotatable shaft. The connecting rod has a first end portion including an opening having a camming member located therein. The first end portion is between and spaced from the first end and the second end of the rotatable shaft. The tamper is connected to a second end portion of the connecting rod.

Several tampers are available on the market and typically include a drive having an output shaft, a housing connecting to the drive, and at least a portion of the output shaft extends into the housing. A camming member is attaches to the output shaft. A connecting rod is provided having a first end portion which extends into the housing wherein the first end portion includes an opening. A second end portion of the connecting rod extends out of the housing. The camming member is movably connected to the first end portion. The cam is at the opening. The output shaft is spaced from the opening. The output shaft extends through the opening. A tamper is connected to the second end portion of the connecting rod. The tamper often comprises a base member or shoe of a particular shape such as an oval or curved oval member.

The tamper tools work on the same principal as an impact hammer or a jack hammer and therefore is subjected to many intense vertical impacts and lots of jarring and shaking. Consequently, the hoses will become strained and will crack or break loose at the connections at the top of the tool as the tool is used. Failure of the hose causes a loss of hydraulic oil which is a safety concern in that the operator can be sprayed with hot hydraulic oil. Further negative issues associated with failed hoses include expensive downtime and repair and replacement of expensive parts in addition to environmental problems.

Another downside to the design of the tamping tool relates to the lack of a comfortable and easy to use handle. Conventional longitudinal tamping tools must be long and slender to fit into the bottom of a post hole. The tamping tools are typically hand held by the rounded vertical cylindrical housing as one wood hold a broom handle. Use of the tool includes lifting and moving the tool around the pole at various positions to tamp the fill dirt and rock around the pole. The tamper is then moved and lifted from the hole so additional fill material can be added to the hole to be tamped tight. Thus, the hole containing the pole is filled and tamped in layers a few inches at a time to insure the fill material is tight around the pole and edges of the hole. After extended use, the vibration together with the holding, raising and using this heavy tool along with the hydraulic hoses becomes strenuous and burdensome to a user.

Another post hole tamping device is available from Greenlee Utility Company as set forth in FIG. 1 as ("PRIOR ART"); however, none of the references provide the handle and adapter improvements made to manipulate the device as set forth in the instant invention. The Greenlee Fairmont hydraulic pole tamper includes a kidney shaped foot or base member. The tool is includes an open and close center with the valve location at the end of the hose. The flow range of hydraulic fluid is from 4 to 6 gallons per minute and the operating pressure is from 1000 to 2000 psi. The foot size is 2.5×8 inches. The tamper rate of tamping is 1,160 blows per minute at 5 gallon per minute flow rate.

SUMMARY OF THE INVENTION

In accordance with the present invention, there is provided a pole tamper comprising, consisting of, or consisting essentially an upright longitudinal cylindrical housing including a hydraulic impact unit with a hydraulic cylinder and piston, two hydraulic hoses, two hose clamps and a handle frame. The piston extends from the bottom of the hydraulic impact unit and has a tamper head fixedly attached thereto. The two hydraulic hoses are fluidly attached to the top end of the hydraulic impact unit. The handle frame is fixedly connected to the top of the longitudinal cylindrical housing. The hand frame includes a horizontal handle, an open ended cylindrical base with the first open end at the top of the cylindrical base and the second open end at the bottom of the cylindrical base. The cylindrical base has a diameter sized to fit down onto a top of the longitudinal cylindrical housing. The handle has two ends, the first end of the handle connected to a top edge of the cylindrical base by a first longitudinal strip and the second end of the handle connected to the top edge of the cylindrical base by a second longitudinal strip at a point opposite of the first longitudinal strip. The first and the second longitudinal strips have a gap there between which is bridged by a cross member having two apertures formed therein. The cylindrical base has two apertures formed in the sidewalls thereof. Also included are two hydraulic hose clamps including elastomeric bushings; and two fasteners capable of fastening the two hydraulic hose clamps with hoses into the two apertures formed within the cross member.

It is an object of this invention to provide a hydraulic pole tamper with an easy to grip handle at the top end similar to what is known a D-grip handle which includes a rounded grip situated at the top end and perpendicular to the longitudinal shaft.

It is an object of this invention to provide a hydraulic pole tamper including hose clamps with elastomeric bushings to cushion the hydraulic hoses against the shock of the hydraulic pulses causing the intense longitudinal thrusts of the tamper head.

It is another object of this invention to provide a hydraulic pole tamper wherein the D-grip handle is part of a handle frame which also includes apertures for the attachment of hose clamps.

It is another object of the present invention to provide a more ergonomic handle easier to grip and control the tamper.

It is another object of the present invention to provide a handle enabling the user to control the orientation of the tamper.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
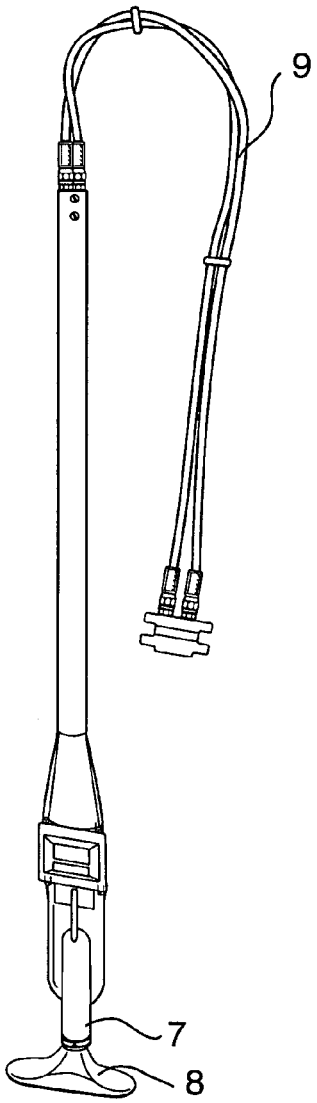
FIG. 1 PRIOR ART
FIG. 1 is a perspective view of the Greenlee Farimont prior hydraulic art pole tamper.
Figure 2:
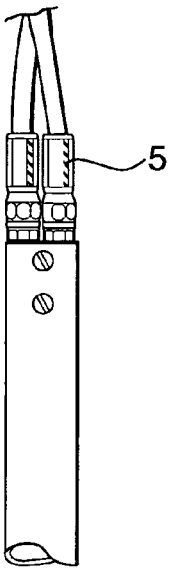
FIG. 2 is an enlarged perspective view of the hydraulic hose connections to the pole tamper of FIG. 1, showing a pair of threaded couplings attaching the hoses to the cooperatively engaging threaded nipples extending from the top distal end of the pole tamper.
Figure 3:
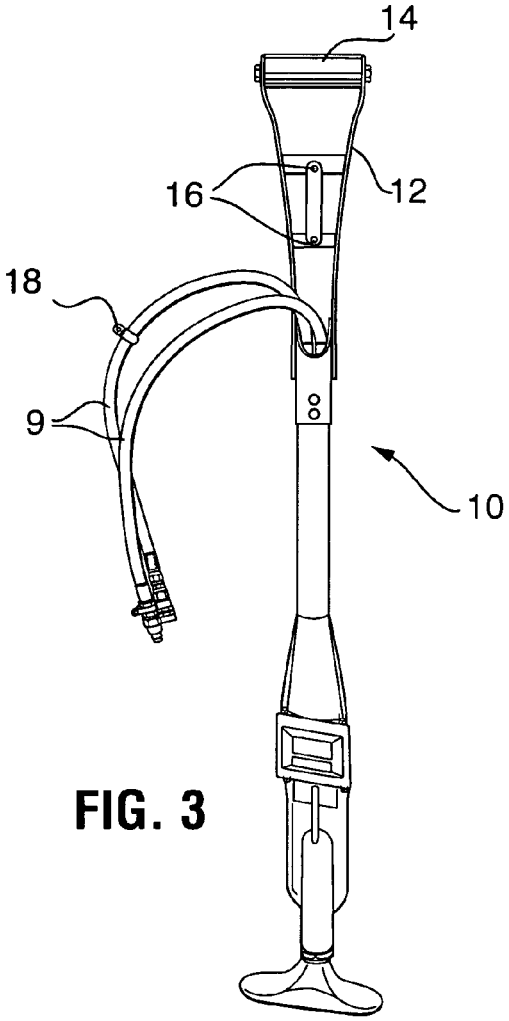
FIG. 3 is a front perspective view of the pole tamper including the handle and adapter including the handle frame and hose clamp improvements.
Figure 4:
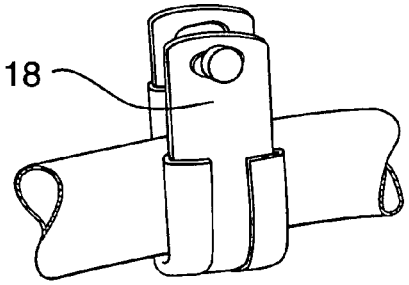
FIG. 4 is an enlarged in view of the hose clamp with the elastomeric bushing.
Figure 5:
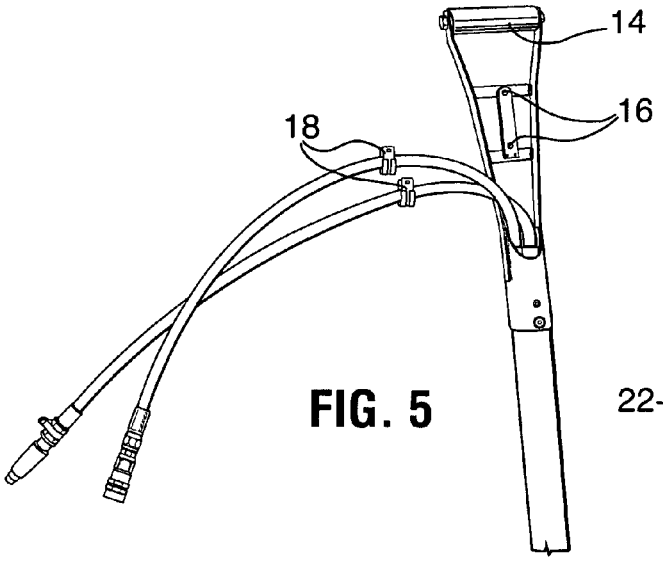
FIG. 5 is an enlarged perspective view of the pole tamper showing the HANSON fittings quick disconnect fittings on the distal ends of the hydraulic hoses extending from the pole tamper hoses.
Figure 7:
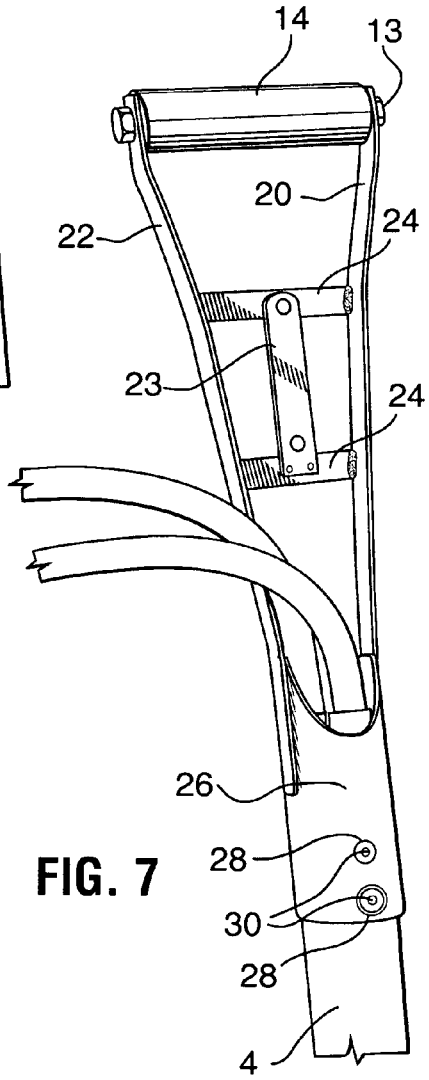
FIG. 7 is an enlarged view of the upper portion of the modified hydraulic pole tamper handle and adapter frame of the present invention also showing the attachment and fasteners fixing the handle frame to the upper shaft of pole tamper.
Figure 6:
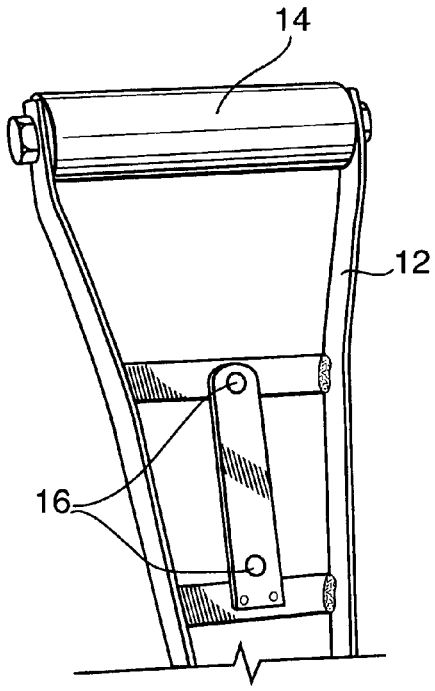
FIG. 6 is an enlarged view of the upper portion of the handle and adapter frame loop including the apertures for attachment of the hose clamps.

In accordance with the present invention, there is provided a hydraulic pole tamper 10 as shown in FIGS. 1-7. The pole tamper 10 as shown in FIGS. 1-2 include a longitudinal cylindrical body 4, a tamper head 8 at the bottom end, two hydraulic hoses 9. The improvement comprises the a handle 1 and a handle loop frame 12 at the top end with hydraulic hose clamps 18 for maintaining the hoses in alignment at the point of connection to the hose junction relieving pressure on the hose. The longitudinal cylindrical body 4 includes a hydraulic impact unit including a hydraulic cylinder and piston 8 and base member or foot 10.

The pole tamper of the prior art, shown in FIGS. 1 and 2 includes a cylindrical longitudinal tool body 4 including an internal piston 7 connected to a ram head 8. Two hydraulic hoses 9 provide the pressurized hydraulic oil to power the tool. The hoses are connected to the cylindrical housing 4 by fittings 5. The tool is meant to be handled by grasping the outer surface of the cylindrical housing 4 as one would hold a broom.

The pole tamper 10 improvement feature of the present invention, shown in FIGS. 3-7, includes all of the elements in the prior art tool along with an adapter loop handle frame 12 and handle 14 connected to the cylindrical housing 4 as shown. The handle frame 12 includes a handle 14 and at the top end, a hollow cylindrical base 26 with an inner diameter large enough to firmly slide down over the top end of the longitudinal cylindrical housing 4. The cylindrical base protects the hose connection fittings and protects the use should one of the hose connections leak or break. A pair of vertically oriented longitudinal members 20, 22 connect a lower first end of the handle 14 to the outer top edge of a cylindrical sleeve 26 which slides over and cooperatively engages the pole tamper cylindrical body 4. The members 20, 22 are spread apart at a selected acute angle for connecting to a handle grip member 13 of a selected length to enable the user to twist the handle grip and control the orientation of the foot shaped tamper or shoe 10 and to twist the pole tamper or lift it in and out of the hole. The overall length of the handle frame 12 is preferably at least twelve inches but may be shorter.

A rod, pin or bolt 13 connects the handle 14 to the members 20 and 22. The outer diameter of cylinder 26 is about two and one half inches. Therefore, the side members 20 and 22 are connected at the ends of the handle 14 and taper downward to the top circular edge of cylinder 26 forming a loop. A pair of cross member braces bridge the gap between the members 20 and 22 to provide lateral stability for the frame 12 and attachment points for the hose clips 18. The handle 14, the cross member braces 24, 25 and the portions of the side members 20 and 22 between the handle and the cross member make up the orientation loop. The cross member brace as shown in the FIG. 6, includes two spaced apart cross members 24 and 25 stretching from side member 20 to side member 22. A third vertical center member 23 is perpendicular to and connects the centers of the cross members 24 and 25. Two apertures 16 are located at the junction of the center member 23 and the cross member braces 24 and 25, for the purpose of attaching hose clamps 18.

Another embodiment of the handle frame has a cross member which comprises a metal plate rather than two strips 24 and 25 connected by a cross strip 23 and includes apertures 16.

Two apertures 28 are present in the sidewall of the cylindrical base 26 for fasteners such as screws 30 which rigidly hold the handle frame 12 to the top of the cylindrical housing 4.

Two hose clamps 18 are included and used to fasten the hydraulic hoses 9 to the handle frame 12 for lateral support. The hose clamps 18 include elastomeric bushings 19 to cushion the hoses 9. The clamps 18 are fastened to the handle frame 12 at the apertures 16 with fasteners such as screw and nut combinations. The clamps enable the hose to bent at a 90 degree angle at a section of the hose other than the distal end connecting to the hydraulic tamper connections. Constant vibration and twisting tends to weaken the hoses at the connection joint to the fittings with conventional tamper tools because the connection point and the bending point are at the same junction which leads to premature failure of the connections and hoses, damage to same, downtime, and potential hazards to the tamper user. Applicants improved orientation handle and design minimize the stress on the hoses, the fittings, and the worker orienting and lifting the tamper during use.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A hydraulic pole tamper handle and adapter for a hydraulic pole tamper comprising an elongated conduit member extending from a longitudinal cylindrical housing and including means for cooperatively connecting a pair of hydraulic hoses extending upward from said longitudinal cylindrical housing, a drive connecting said longitudinal cylindrical housing to a tamper adapted to reciprocate relative to said housing and apply pressure to a surface, and a wobble connection between said drive and said tamper, wherein said wobble connection comprises a wobble plate and is adapted to reciprocate relative to said longitudinal cylindrical housing, applying pressure to compact a surface such as dirt or rock:

an improvement consisting of:

a handle frame adapter fixedly connected to atop of said longitudinal cylindrical housing, said handle frame adapter including a horizontal handle grip member, an open ended cylindrical base with a first open end at a top of said cylindrical base and a second open end at a bottom of said cylindrical base, said cylindrical base having a diameter sized to fit down onto a top of said longitudinal cylindrical housing, said handle having two ends, a first end of said handle connected to a top edge of said cylindrical base by a first longitudinal strip, a second end of said handle connected to a top edge of said cylindrical base by a second longitudinal strip at a point opposite of said first longitudinal strip, said first and said second longitudinal strips having a gap there between, said gap being bridged by a cross member, said cross member having two apertures formed therein; said cylindrical base having two apertures formed in a sidewall thereof;

two hydraulic hose clamps including elastomeric bushings therein attaching to said cross member;

means for fastening said two hydraulic hose clamps with hoses to said cross member; and said means for connecting a pair of hose connections of said hydraulic hoses comprising spring loaded quick connect couplings affixed to said distal end of said hydraulic hose for cooperatively engaging a nipple extending from said upper end of said elongated conduit member of said pole tamper.

2. The hydraulic pole tamper handle assembly of claim 1, wherein a holding means comprises a fastener attaching a clamp affixed to said hydraulic hoses to a brace extending between a pair of cross members joining said longitudinal strips.

3. The hydraulic pole tamper handle assembly of claim 1, wherein said handle grip member comprises a straight cylindrical member connecting said longitudinal strips.

4. A hydraulic pole tamper and handle frame assembly comprising:

a hydraulic pole tamper comprising an elongated conduit member extending from a housing and including means for cooperatively connecting a pair of hydraulic hoses extending upward from said housing, a drive connecting said housing to a tamper adapted to reciprocate relative to said housing and apply pressure to a surface, and a wobble connection between said drive and said tamper, wherein said wobble connection comprises a wobble plate and adapted to reciprocate relative to said housing applying pressure to compact a surface such as dirt or rock;

said handle frame assembly attaching to a top portion of said upper end of said elongated conduit member, said handle frame assembly including a handle frame comprising a pair of spaced apart aligned longitudinal arms extending upward from a bottom portion defining a cylindrical base attaching to said elongated conduit member, said longitudinal arms including an upper portion having a pair of spaced apart aligned distal ends connecting to a handle grip member extending there between, said cylindrical base including a first open end at a top of said cylindrical base and a second open end at a bottom of said cylindrical base, said cylindrical base having a diameter sized and shaped for coaxial engagement with said upper end of said elongated conduit member of said pole tamper, said cylindrical base extending around and shielding at least a portion of said means for connecting said hydraulic hoses to said upper end of said elongated conduit member, said handle frame assembly including at least one cross member disposed between said longitudinal arms at a position above said means for connecting and removably securing said hydraulic hoses, and hydraulic hoses holding means attaching to said at least one cross member for holding said hydraulic hoses in vertical alignment with said upper end of said elongated conduit member of said pole tamper, said hydraulic hoses holding means attaching to said handle frame at a position above said cylindrical base, and said hydraulic hoses extending through an upper end of said cylindrical base removably attaching to said hydraulic hoses holding means; and said means for connecting a pair of hose connections of said hydraulic hoses comprising spring loaded quick connect couplings affixed to said distal end of said hydraulic hose for cooperatively engaging a nipple extending from said upper end of said elongated conduit member of said pole tamper.

5. The hydraulic pole tamper and handle frame assembly of claim 4, wherein said holding means comprises a fastener attaching a clamp affixed to said hydraulic hoses to a brace extending between a pair of cross members joining said longitudinal arms.

6. The hydraulic pole tamper and handle frame assembly of claim 4, wherein said handle grip member comprises a straight cylindrical member connecting said longitudinal arms.

7. A hydraulic pole tamper and handle frame assembly, comprising:

a hydraulic pole tamper comprising an upper end defining an elongated conduit member including means for cooperatively connecting a pair of hydraulic hoses extending upward from a housing, a drive connecting the housing, a tamper adapted to reciprocate relative to the housing and apply pressure to a surface, and a wobble connection between the drive and the tamper, wherein the wobble connection comprises a wobble plate, wherein a first end portion of the tamper is at a side of the wobble plate adapted to reciprocate relative to the housing and apply pressure to a surface such as dirt or rock; and a handle assembly for cooperatively engaging said elongated conduit member of said hydraulic tamper pole, comprising a handle frame comprising a pair of spaced apart aligned longitudinal arms extending upward from a sleeve coaxially affixed to and mounted on an upper end of said elongated conduit member of said pole tamper, said sleeve extending around and shielding at least a portion of said means for connecting said hydraulic hoses to said upper end of said elongated conduit member, said longitudinal arms having a pair of spaced apart aligned distal ends connecting to a handle grip member extending there between, holding means attaching to said longitudinal arms at a position above said means for connecting said hydraulic hoses for removably securing said hydraulic hoses in vertical alignment with said upper end of said elongated conduit member of said pole tamper, said sleeve having a diameter sized and shaped for coaxial engagement with said upper end of said elongated conduit member of said pole tamper, said sleeve extending around and shielding at least a portion of said means for connecting said hydraulic hoses to said upper end of said elongated conduit member, said handle frame assembly including at least one cross member disposed between said longitudinal arms at a position above said means for connecting and removably securing said hydraulic hoses, and hydraulic hoses holding means attaching to said at least one cross member for holding said hydraulic hoses in vertical alignment with said upper end of said elongated conduit member of said pole tamper, said hydraulic hoses holding means attaching to said handle frame at a position above said sleeve, and said hydraulic hoses extending through an upper end of said sleeve removably attaching to said hydraulic hoses means; and said means for connecting a pair of hose connections of said hydraulic hoses comprising spring loaded quick connect couplings affixed to said distal end of said hydraulic hose for cooperatively engaging a nipple extending from said upper end of said elongated conduit member of said pole tamper.

8. The hydraulic pole tamper and handle assembly of claim 7, wherein said holding means comprises a fastener attaching a clamp affixed to said hydraulic hoses to a brace extending between a pair of cross members joining said longitudinal arms.

9. The hydraulic pole tamper and handle assembly of claim 7, wherein said handle grip member comprises a straight cylindrical member connecting said longitudinal arms.

* * * * *